United States Patent [19]

Stana

[11] 4,332,776

[45] Jun. 1, 1982

[54] EXTRACTANT SOLVENT RESTORATION IN THE PROCESS FOR RECOVERY OF URANIUM FROM PHOSPHORIC ACID

[75] Inventor: Regis R. Stana, Lakeland, Fla.

[73] Assignee: Wyoming Mineral Corporation, Lakewood, Colo.

[21] Appl. No.: 92,866

[22] Filed: Nov. 8, 1979

[51] Int. Cl.[3] ..... C01G 43/00

[52] U.S. Cl. ..... 423/10; 423/8; 423/9

[58] Field of Search ..... 423/10, 8, 9

[56] References Cited

U.S. PATENT DOCUMENTS

| | | | |
|---|---|---|---|
| 2,830,872 | 4/1958 | McCullough | 423/10 X |
| 2,835,552 | 5/1958 | McGinnis | 423/10 X |
| 3,320,033 | 5/1967 | Goren | 423/10 |
| 3,711,591 | 1/1973 | Hurst et al. | 423/10 |
| 3,996,872 | 6/1976 | Sundar et al. | 423/10 X |
| 4,087,512 | 5/1978 | Reese et al. | 423/10 |
| 4,162,230 | 7/1979 | Horwitz et al. | 423/10 X |
| 4,190,633 | 2/1980 | Smith et al. | 423/8 |
| 4,258,013 | 3/1981 | Pyrih et al. | 423/10 |

OTHER PUBLICATIONS

Perry et al., "Chemical Engineers' Handbook", 5th Ed., pp. 15–23, McGraw-Hill Book Co. (1973) New York.

*Reactor Handbook, vol. II, Fuel Reprocessing,* p. 109, Interscience, N.Y., 1961.

*Primary Examiner*—Edward A. Miller

*Attorney, Agent, or Firm*—D. P. Cillo

[57] ABSTRACT

A process to restore solvent after the stripping step in recovering uranium from phosphoric acid, comprises passing stripped, water-immiscible organic extraction solvent, containing contaminants and having a lowered uranium extraction coefficient value, through a water scrub, to scrub contaminants from the organic solvent and raise its uranium extraction coefficient. The scrubbed solvent is then passed back to the extractor and the contaminated water is passed into at least one purification means and then back to the scrubber.

9 Claims, 1 Drawing Figure

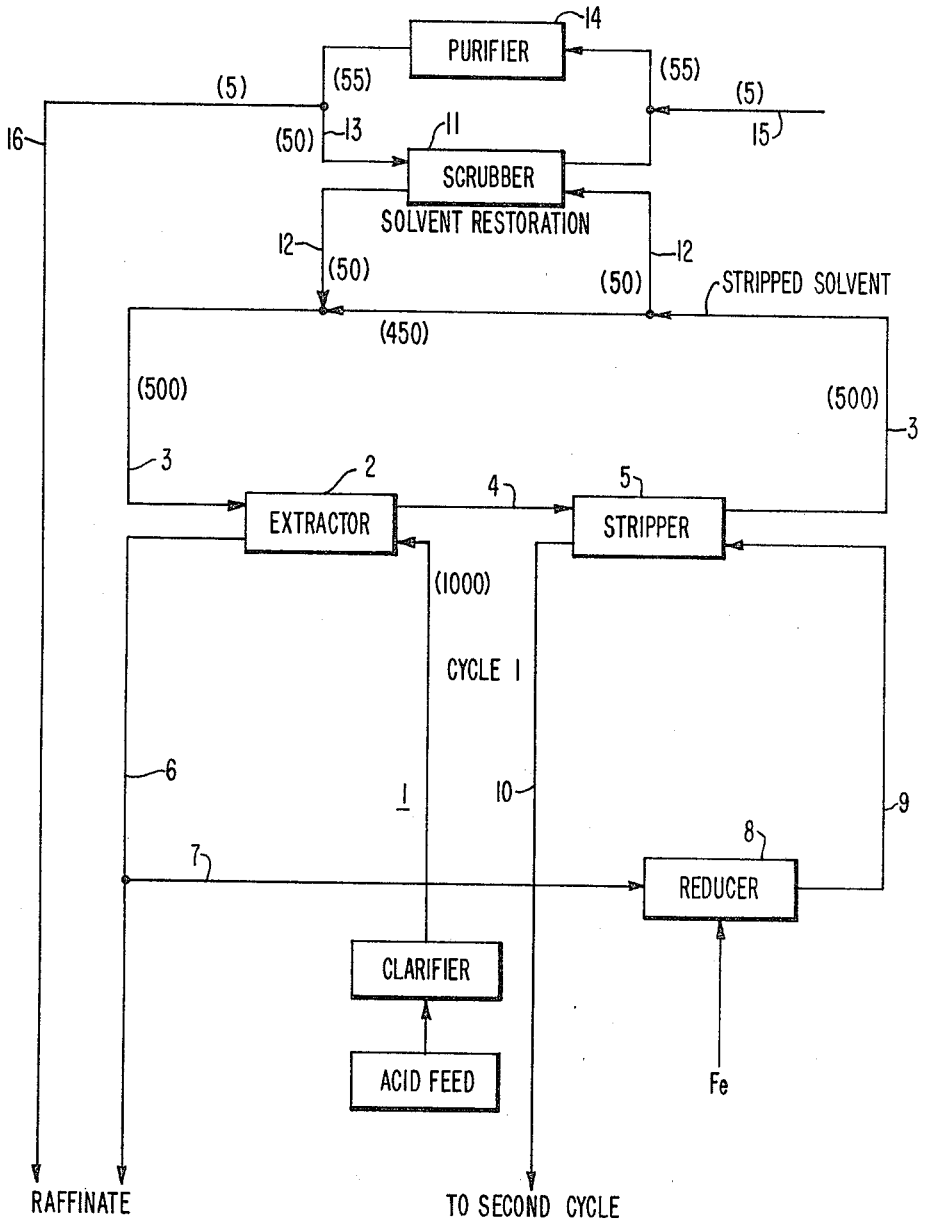
PURIFIER
14
(55)
(55)
(5)
(5)
15
16
(50)
13
11
SCRUBBER
SOLVENT RESTORATION
12
12
(50)
(50)
STRIPPED SOLVENT
(450)
(500)
(500)
3
3
2
4
5
EXTRACTOR
STRIPPER
(1000)
CYCLE I
6
1
10
9
8
7
REDUCER
CLARIFIER
ACID FEED
Fe
RAFFINATE
TO SECOND CYCLE

EXTRACTANT SOLVENT RESTORATION IN THE PROCESS FOR RECOVERY OF URANIUM FROM PHOSPHORIC ACID

BACKGROUND OF THE INVENTION

Uranium and other metal values can be recovered from commercial grade wet process phosphoric acid by liquid-liquid extraction processes. In these processes, phosphoric acid solution is contacted, generally in a multistage, counter-current extractor, with an organic extractant solvent composition having an affinity for uranium values. After extraction, two phases are formed, namely an aqueous phase and an organic phase rich in uranium values. Then, the organic phase is stripped of its uranium content, and the stripped organic solvent is returned to the extraction system.

McCullough, in U.S. Pat. No. 2,830,872 and McGinnis, in U.S. Pat. No. 2,835,552, recognized that the organic extractant solvent composition can lose its uranium extraction efficiency after about 7 passes through the extraction-stripping system. The uranium extraction coefficient, E°, which should be high, i.e. at least about 2.0, and preferably between about 4.0 to 5.0, was found to decay from an initial value of 6, to a decayed value of about 1.0 to 1.5. This extraction decay requires either increasing the number of equilibrium stages in the extractor, increasing the solvent to aqueous ratio, or discarding the solvent, which usually contains many expensive components. In a similar area, Sundar et al., in U.S. Pat. No. 3,966,872, recognized that the uranium-rich extractant solvent also contained ferric ions which could be removed by water scrubbing the entire stream after extraction but before stripping, so that amine extraction in subsequent cycles was not interfered with.

McCullough solved his extraction decay problem by heating the stripped organic solvent to 60° C. to evolve hydrofluoric acid, followed by treating the solvent with solid phosphorous pentoxide, and then washing the treated solvent with 60% orthophosphoric acid prior to recycle to the extraction system. McGinnis, in solving a similar type of problem, washed the solvent with 5% sulfuric acid to strip hydrofluoric acid from the solvent, prior to solvent recycle to the extraction system. While the McCullough and McGinnis processes are effective to varying degrees, a simpler, less expensive method of treatment is needed to solve solvent extraction decay problems.

SUMMARY OF THE INVENTION

A new and useful process has been discovered to remedy extractant solvent decay in recovering uranium values from phosphoric acid solution. Scrubbing, at least a portion of the decayed, stripped organic extractant with water will restore its extraction efficiency. After extraction and stripping, an amount of the stripped, water-immiscible organic extraction solvent, preferably from about 5 vol.% to about 35 vol.% of the stripped solvent stream, containing contaminants and having a lowered uranium extraction coefficient value, is then passed from the stripper into a scrubber.

In the scrubber, the organic solvent is contacted with water, to scrub contaminants, mainly dissolved organics, from the organic solvent, raise its uranium extraction coefficient value, and to provide a scrubbed water-immiscible, organic solvent composition stream and a water stream containing contaminants. The scrubbed organic solvent is passed back to the extractor, and the contaminated water stream is passed into at least one purification means, preferably containing activated carbon, to provide a purified water stream which is fed back into the scrubber means.

Decayed solvent extractant, having a uranium extraction coefficient value of 2.9, has been restored to provide a uranium extraction coefficient value of 5.2 by the post-stripping, water-scrub method of this invention. The use of carbon purification of the scrub water, allows its reuse without loss of effectiveness in restoring the uranium coefficient extraction values of the solvent extractant.

DESCRIPTION OF THE DRAWING

For a better description of the invention, reference may be made to the preferred embodiments exemplary of the invention, shown in the accompanying drawing, which shows a flow diagram of one process for extracting uranium values from an aqueous phosphoric acid feed, incorporating a water wash step of a fraction of recycled organic extractant solvent.

DESCRIPTION OF THE PREFERRED EMBODIMENTS

Referring to the drawing, one method of extracting metal values from an acidic solution is shown. More specifically, the process involves one type of process for the extraction of uranium values from 30% $H_3PO_4$. In Cycle I, clarified phosphoric feed acid solution, containing uranium values and unsettleable contaminants, from line 1, enters extractor-settler means 2, which may contain 1 to 10 stages. This feed is typically a 35° C. to 50° C. aqueous 5 M to 6 M solution of phosphoric acid having a pH of up to about 1.5 and containing about 0.05 to about 0.5 g/l of uranium. In the process shown, the phosphoric acid may be oxidized before entering the extractor-settler by any suitable means, to ensure that the uranium is in the +6 oxidation state, i.e., uranyl ion. In the extractor-settler, the feed acid is contacted by mixing with a water-immiscible, organic extractant solvent composition from line 3. The extractant solvent composition contains a reagent dissolved in a hydrocarbon diluent. The reagent extracts the uranyl ions to form a uranium complex soluble in the organic solvent.

Typically, the extractant solvent composition from line 3 is added in a 0.3 to 3 phosphoric feed acid to organic solvent composition ratio (by volume). The extractant solvent composition from line 3 can contain, for example, about 0.2 to 0.7 mole of a dialkyl phosphoric acid having about 4 to 12 carbon atoms in each chain, preferably di(2-ethylhexyl) phosphoric acid (D2EHPA-reagent) per liter of extractant solvent composition. The extractant solvent composition may also contain about 0.025 to about 0.25 mole of a synergistic agent well known in the art, for example, a trialkyl phosphine oxide, where the alkyl chains are linear, having from 4 to 10 carbon atoms, preferably trioctyl phosphine oxide (TOPO) per liter of extractant solvent composition. These synergistic agents allow reduction of equipment size while increasing uranium extraction. The usual mole ratio of D2EHPA:TOPO is from about 3 to 5:1.

The solvent or diluent is a hydrocarbon liquid having a boiling point of over about 70° C. Preferably, the hydrocarbon will have a boiling point over about 125° C. The hydrocarbon must be essentially immiscible with the metal containing aqueous solution such as the hot phosphoric acid. It may have a substantially zero extraction coefficient for the metal containing solution. The preferred hydrocarbons are refined, high boiling, high flash point, aliphatic or aliphatic-aromatic solvents. The most useful hydrocarbon is a product of distillation of petroleum having a boiling point of between about 150° C. and about 300° C., and can be, preferably, a refined kerosine. The extractant solvent composition must contain from about 50 vol.% to about 90 vol.% hydrocarbon solvent diluent and about 10 vol.% to about 50 vol.% metal extractant reagent, such as a mixture of di-alkyl phosphoric acid and trialkyl phosphine oxide. These organic extractant solvent compositions are well known in the art.

In the process shown in the drawing, the extractant solvent composition, containing complexed uranium and contaminates, passes through line 4 to reductive stripper means 5, which may contain 1 to 4 stages, to strip uranium from the organic solvent. A portion of the raffinate from extractor 2 passes through lines 6 and 7 to reducer 8 where iron (Fe°) is added to reduce ferric ions to ferrous ion. The ferrous ion enters reductive stripper 5 by line 9 and is oxidized there to the ferric ion, while reducing the uranyl ion to the quadravalent $U^{+4}$ ion. The $U^{+4}$ ion enters the aqueous stream strip solution in line 10. The organic solvent leaving the stripper is then recycled through line 3 to extractor 2. In a continuous process of this invention, at least a part of the organic solvent leaving the stripper is scrubbed with water in scrubber 11.

The $U^{+4}$ ion in the strip solution in line 10 may be oxidized to the uranyl ion, to enable the uranium to be extracted again in Cycle II. The product strip solution from Cycle I is an aqueous phosphoric acid solution and typically has a pH of about 1 to 4. It may contain about 15 g/l to 40 g/l of iron, about 2 g/l to 15 g/l of uranium, and other contaminating cations including Group II and III metal ions and rare earths.

In the method of this invention, water is used to wash the extractant solvent composition, after it exits the stripper 5, preferably in a countercurrent scrubber 11 disposed on line 12 between and separate from the extractor-settler and the reductive stripper. The water used is fresh water, i.e., ordinary tap or ground water containing normal amounts of solids or water which has been filtered as described hereinbelow.

The volume ratio of water:organic extractant solvent composition used in the scrubber 11 can vary between about 1:0.2 to 1:2.5, but is preferably 1:1. Use of over about 2.5 parts extractant/1 part water , the E° value would not be increased appreciably. Under 0.2 parts, little of the total cycling extractant will be restored. The water wash from line 13 is fed continuously into the scrubber 11 where it washes a portion , preferably about 5 vol.% to about 35 vol.% of the stream 3 extractant solvent composition exiting the stripper 5 and separated into line 12. Feeding over about 35 vol.% of stream 3 into the scrubber 11 would require unnecessarily large scrubbing units. While one scrubber-filter system is shown tapped into line 3, a plurality may be used effectively, all operating together, or each operating separately while the others allow extra time for the scrub water to be filtered.

The preferred scrubbing system uses recycled water in line 13 that is passed through a purifier filter 14. Carbon consumption is only about 1 lb./lb. of uranium in this solvent restoration method, and $D_2EHPA$-TOPO reagent losses are very small since both reagents are essentially insoluble in water. A plurality of purification units can be used with each scrubber to allow maximum water contact with the filter medium, preferably about 5 minutes.

Activated carbon is the preferred water purifier. This is a well-known material, usually made by heating previously charred carbonaceous materials to a high temperature in the presence of steam. These activated carbons are solid carbon foams, herein defined as having a surface area, mostly internal, of over about 600 sq. meters/grams, with average values of 1,400 to 1,600 sq. meters/gram. These carbon granules are permeated with a complex internal network of submicroscopic channels into which impurity molecules can migrate and where they are drawn to the internal wall surface and physically trapped.

Channel carbon blacks such as acetylene black, having surface areas of between 80 to 600 sq. meters/gram are not as useful as activated carbons. Of course, other filtering materials effective to remove the contaminants transferred from the stripped solvent would be useful in this method.

As shown in the method described in the drawing, of the 500 liters/unit time of solvent exiting the stripper, 50 liters is split into stream 12 and passes through the scrubber 11, countercurrent contacting 50 liters of purified water from stream 13. The uranium extraction coefficient value, E°, is, as a result, raised to a value at least above 2.0. The uranium extraction coefficient value equals the uranium in wt./vol. in the organic fraction divided by uranium in wt./vol. in the acidic fraction. This value can be easily calculated by methods well known in the art. The scrubbed organic solvent is then fed back into stream 3 and into the extractor.

Additional water from line 15 is added to the scrub water which is fed into purifier 14, and a portion of the water leaving the scrubber is bled into line 16. When the phosphoric acid concentration of stream 13 reaches about 3 vol.%, the stream is fed into an evaporation or other type of system to recover the phosphoric acid. If scrub water was not recycled, major portions of the phosphoric acid would be lost.

The impurities removed from the extractant solvent composition in scrubber 11 and substantially removed from the scrub water by the purifier 14, contain a variety of dissolved inorganics and organics, including humic materials that are solubilized in the acid during its production. Why these impurities retard uranium extracting is not completely understood, but it is believed that they tie up the active sites of the D2EHPA:-TOPO extractant reagents.

While the solvent restoration method of this invention has been described in relation to the reductive stripping process of the drawing, it can be used after the stripping step in any type of uranium recovery system where a water-immiscible organic extractant is contaminated with materials which cause its uranium extractor qualities to decay below commercially feasible extraction values.

EXAMPLE

In a pilot operation, similar to that shown in the drawing, fresh, hot, commercial grade wet process, aqueous, phosphoric acid (30% $P_2O_5$; sp. gr. = 1.36), containing humic acids, supersaturated salts, and about 0.2 gram/liter of uranium along with various other impurities, was fed into a surge tank cooling means with a cooling coil where it was cooled from about 60° C. to about 40° C. The cooled aqueous phosphoric acid was then fed into a clarifier to settle and reduce solids content.

The phosphoric feed acid solution was then fed into an extractor-settler, where uranium values are extracted into water-immiscible, organic extractant solvent composition containing 0.5 mole of di-2-ethylhexyl phosphoric acid (D2EHPA) and 0.125 mole of tri-n-octylphosphine oxide per 1 liter of kerosine as diluent. The volume rates of feed phosphoric acid:extractant solvent composition mixing in the extractor-settler was about 2:1.

The organic extractant solvent, containing uranium values was passed from the settler to a reductive stripper at about 25° C., to strip uranium values from the solvent into an immiscible aqueous solution. The stripped organic extractant solvent was then cycled back to the extractor. This cycle was repeated, until after about 75 cycles, the water-immiscible organic extractant solvent composition had a reduced uranium extraction coefficient of 2.91 as it exited the stripper. The extractant solvent stream after passing through the reductive stripper was then split up. About 50 parts by volume was fed into a water scrubber and about 450 parts by volume was fed back into the extractor.

In the water scrubber, 50 parts by volume of fresh tap water was countercurrent contacted with 50 parts of water-immiscible solvent. The uranium extraction coefficient of the organic extractant solvent as it exited the water scrubber varied from 4.83 to 4.88, a 67% increase after one pass. In a similar process 100 parts by volume of tap water was countercurrent contacted with 50 parts of water-immiscible solvent. Here, the uranium extraction coefficient of the organic extractant solvent as it exited the water scrubber was 5.18, a 77% increase after one pass, almost restoring the solvent to its initial $E^\circ = 5.5$ value.

In both cases, after the tap water contact with the contaminated solvent, the purified organic solvent was fed back to the extractor and the contaminated water was fed into a purification filter containing activated carbon with an internal surface area over about 600 sq. meters/gram. For each 50 parts by volume of water out of the scrubber, 5 parts was added before the filter and 5 parts bled off after the filter, as shown in the drawing, the bled off portion was treated to recover any phosphoric acid present. In all cases, substantially no solvent was entrained in the water.

In another instance water was used for a second cycle without purification, and on a volume basis of water:-solvent of 50:50, the uranium extraction coefficient of the organic extractant solvent as it exited the water scrubber was 4.2, as compared to 4.86 for the initial fresh water or purified water use. Successive reuses of the water without purification gave further degradation in the $E^\circ$ values, showing the importance of the water purification step in the solvent restoration process. On the other hand, if the contaminated scrub water is contacted with activated carbon for 10 to 15 minutes between reuses, there is no apparent degradation in the restoration power of the water for up to about 7 to 10 reuses.

Loading tests with the activated carbon showed that a loading of at least 0.15 lb. of organic contaminants per 1 lb. of activated carbon could be achieved before the carbon began to lose its filtering purification effect. Assuming 10 vol.% of the solvent flow through the uranium extraction process, i.e., 50 of 500 parts by volume is washed continuously with an equal volume of water, and that the water will have about 500 parts/million of organic contaminants, the activated carbon required for this process would be less than 1.0 lb./lb. of uranium.

I claim:

1. A process of purifying organic extractant solvent in a uranium recovery process, comprising the steps of:

(A) passing phosphoric acid solution containing uranium values and contaminants into an extractor means and contacting it with a water-immiscible, organic extractant solvent composition, having a uranium extraction coefficient of at least about 2.0, to extract uranium values and contaminants from the acid solution, and then (B) passing the organic solvent, containing uranium values and contaminants, into a stripper means, to strip uranium values from the organic solvent, and to provide a stripped organic solvent stream still containing contaminants and having a lowered uranium extraction coefficient value, and then (C) passing from about 5 vol. % to about 35 vol. % of the stripped organic solvent stream from the stripper means into a water scrubber means and contacting it with water, containing no more than about 3 vol. % phosphoric acid as an impurity, to scrub contaminants from the organic solvent and raise its uranium extraction coefficient value, to provide a scrubbed water-immiscible, organic extractant solvent composition stream and a water stream containing contaminants, and then (D) passing the scrubbed organic solvent back to the extractor means, and (E) passing the contaminated water stream into at least one purification means, to provide a purified water stream which is fed back into the scrubber means.

2. The method of claim 1, where the volume ratio of water:organic solvent in step (C) is between about 1:0.2 to 1:2.5.

3. The method of claim 1, where the purification means in step (E) contains activated carbon having an internal surface area of over about 600 sq. meters/gram.

4. The method of claim 3, where the solvent and water countercurrent contact each other in step (C).

5. The method of claim 1, where the uranium extraction coefficient of the organic solvent after step (C) is over 2.0.

6. The method of claim 1, where the extractant solvent composition comprises dialkyl phosphoric acid, trialkyl phosphine oxide and hydrocarbon diluent.

7. The method of claim 1, where the extractant solvent composition comprises di(2-ethylhexyl) phosphoric acid, trioctyl phosphine oxide and hydrocarbon diluent.

8. A process of purifying stripped organic extractant solvent in a uranium recovery process, comprising the steps of:

(A) passing phosphoric acid solution containing uranium values and contaminants into an extractor means and contacting it with a water-immiscible, organic extractant solvent composition, having a uranium extraction coefficient of at least about 2.0, to extract uranium values and contaminants from the acid solution, and then (B) passing the organic solvent, containing uranium values and contaminants, directly into a stripper means, to strip uranium values from the organic solvent, and to provide a stripped organic solvent stream still containing contaminants and having a lowered uranium extraction coefficient value, and then (C) passing from about 5 vol.% to about 35 vol.% of the stripped organic solvent stream from the stripper means into a water scrubber means and countercurrent contacting it with water containing no more than about 3 vol.% phosphoric acid as an impurity, in a volume ratio of water:organic solvent of between about 1:0.2 to 1:2.5, to scrub contaminants from the organic solvent and raise its uranium extraction coefficient value, to provide a scrubbed water-immiscible, organic extractant solvent composition stream and a water stream containing contaminants, and then (D) passing the scrubbed organic solvent back to the extractor means, and (E) passing the contaminated water stream into at least one purification means, to provide a purified water stream which is fed back into the scrubber means.

9. The method of claim 8, where the extractant solvent composition comprises di(2-ethylhexyl) phosphoric acid, trioctyl phosphine oxide and hydrocarbon diluent, and the filter means in step (E) contains activated carbon having an internal surface area of over about 600 sq. meters/gram.

* * * * *